United States Patent [19]

Elmer et al.

[11] Patent Number: 5,032,805

[45] Date of Patent: Jul. 16, 1991

[54] RF PHASE SHIFTER

[75] Inventors: Frank J. Elmer, Spring Lake Heights, N.J.; Kaiser S. Kunz, Las Cruces, N. Mex.; Sei Joo Jang, State College, Pa.

[73] Assignee: The United States of America as represented by the Secretary of the Army, Washington, D.C.

[21] Appl. No.: 425,549

[22] Filed: Oct. 23, 1989

[51] Int. Cl.[5] ..... H01P 1/18

[52] U.S. Cl. ..... 333/156; 333/161

[58] Field of Search ..... 333/156, 157, 164, 161, 333/250, 35; 343/754, 909, 756

[56] References Cited

U.S. PATENT DOCUMENTS

| | | | |
|---|---|---|---|
| 3,466,575 | 9/1969 | Chang | 333/157 |
| 3,631,501 | 12/1971 | Buscher | 333/157 X |
| 3,721,923 | 3/1973 | Gray et al. | 333/157 |
| 3,944,950 | 3/1976 | Jacobs et al. | 333/164 |
| 4,323,901 | 4/1982 | De Wames et al. | 343/754 |
| 4,565,982 | 1/1986 | Stern et al. | 333/157 |
| 4,757,688 | 7/1988 | Basiulis et al. | 62/3.2 |
| 4,809,011 | 2/1989 | Kunz | 343/787 X |

FOREIGN PATENT DOCUMENTS

| | | | |
|---|---|---|---|
| 1352561 | 11/1987 | U.S.S.R. | 333/157 |
| 1356048 | 11/1987 | U.S.S.R. | 333/157 |

*Primary Examiner*—Eugene R. LaRoche
*Assistant Examiner*—Seung Ham
*Attorney, Agent, or Firm*—Michael Zelenka; William H. Anderson

[57] ABSTRACT

An electrically controlled RF phase shifter having an active medium formed from a ceramic material the permittivity of which may be varied by varying the strength of an electric field in which it is immersed. The phase shifter includes the ceramic material having electrodes mounted thereon that are connected to an adjustable d-c voltage source. The phase shifter may be placed in an RF transmission line that includes appropriate input and output impedance matching devices such as quarter-wave transformers. The phase of the RF power exiting the phase shifter will depend on the effective electrical length of the material in the active medium. Because changes in the permittivity of the material will produce corresponding changes in the electrical length of the material, changes in the phase of the RF power transmitted therein will be produced. The quarter-wave transformers may also be made of a similar adjustable permittivity material. Control voltages applied to the transformers are used to adjust the amount of output power. An interdigitated electrode is used to reduce the amount of voltage needed to operate the phase shifter. The phase shifter may be embedded as part of a microwave integrated circuit.

8 Claims, 3 Drawing Sheets

RF PHASE SHIFTER

The invention described herein may be manufactured, used, and licensed by or for the Government for governmental purposes without the payment to us of any royalties thereon.

BACKGROUND OF THE INVENTION

1. Field of the Invention

The present invention relates to phase shifters for electromagnetic waves and, more particularly, to RF phase shifters, delay lines and the like which may be controlled electrically.

2. Description of the Prior Art

In many fields of electronics, it is often necessary that the phase of an electronic signal be controlled such that an output signal has some desired phase relation with respect to the input signal. In the field of RF signal transmission, phase shifter waveguides have been routinely employed for adjusting the phase of a particular electromagnetic field component at an output relative to the phase of that field component at the input. When the RF signal to be phase shifted is in the microwave or millimeter wave band, it is customary to employ ferrite phase shifters in waveguide transmission circuits to do the phase shifting job. These devices usually accomplish phase shifting by varying the transmission delay or transit time of the RF signal over a predetermined distance and, therefore, varying the phase of the signal as it passes through the ferrite. Although such devices have served the purpose, they have not proven entirely satisfactory under all conditions of service for the reasons that considerable difficulty has been experienced with phase shift sensitivity in extreme temperature conditions and difficulties encountered due to hysteresis effects. These problems, inherent in ferrite materials, usually result in substantial power losses, signal distortions, noise, etc.

More specifically, a ferrite phase shifter is a two-port RF transmission line in which the phase of the output signal is varied by changing a d-c magnetic field in which the ferrite is immersed. Phase shifts up to 360 degrees are obtainable in a relatively small structure. However, unwanted variations in the output phase due to temperature changes or ambient magnetic fields or both have often required that these devices be contained in a controlled environment. In some situations, the inconvenience of a temperature-controlled environment may be eliminated with a feedback control loop about the ferrite phase shifter to precisely control the phase shift. In either case, the additional costs necessary to mitigate the adverse affects of temperature and other hostile ambient conditions, and the attendant loss in phase shift sensitivity have led designers of RF phase shifters to look elsewhere for better solutions to these critical problems. Consequently, those concerned with the development of electronically controlled phase shifters have long recognized the need for more reliable, more sensitive and less costly RF phase shifters. The present invention fulfills this need.

SUMMARY OF THE INVENTION

The general purpose of this invention is to provide an electrically controlled phase shifter which embraces all of the advantages of similarly employed conventional devices, such as ferrite phase shifters, yet it avoids many of the aforementioned disadvantages. Compared to conventional phase shifters, the phase shifter of the present invention is less expensive to fabricate, more reliable to use, better capable of handling higher RF powers, more accurately controlled, and less susceptible to temperature changes, magnetic fields and other ambient conditions. Additionally, the phase shifters of the present invention have the potential for direct integration into the packaging and structures of microwave and millimeter wave integrated circuits.

To attain this, the present invention contemplates the use of a transmission line formed from a material which changes permittivity by changing an applied d-c electric field in which it is immersed. The change in permittivity causes a change in the effective electrical length of the active section of the transmission line, thereby changing the transit time (transmission delay) or phase of an RF wave propagating therein. The invention uses a d-c voltage to establish the applied electric field.

It is, therefore, an object of the present invention to provide a voltage controlled ceramic phase shifter which uses less control power and is capable of handling higher RF power than conventional phase shifters.

Another object of the invention is to provide a phase shifter having a lower fabrication cost than conventional phase shifters.

A still further object is to provide an RF phase shifter capable of efficient operation over a greater temperature range than conventional phase shifters.

An additional object of the present invention is to provide an RF phase shifter which can be integrated into the structure of microwave and millimeter wave integrated circuits.

Another object of the invention is to provide a material which changes its permittivity with applied d-c electric field to change the effective electrical length of the active section of a transmission line, thereby changing the delay, or the phase of an RF wave propagating therein.

These and other objects are achieved in accordance with the present invention which comprises an RF transmission line having an input matching section, an active section, and an output matching section. The active section is constructed from a ceramic material, such as strontium-barium titanate, the permittivity of which changes with changes in applied electric field. The change in permittivity results in a change in the effective electrical length of the device, thus changing the delay or phase of the RF wave propagating through the device. In one embodiment, the input matching section and the output matching section are also constructed of a material similar to the material of the active section. In this case, control voltages applied to these matching sections will change their effective electrical length enough to cause them to act as signal attenuators. As such, both the phase and amplitude of the RF output signals may be readily adjusted electrically.

With these and other objects in view, as will hereinafter more fully appear, and which will be more particularly pointed out in the appended claims, reference is now made to the following description taken in connection with the accompanying drawings.

DETAILED DESCRIPTION OF THE PREFERRED EMBODIMENT

Figure 1:
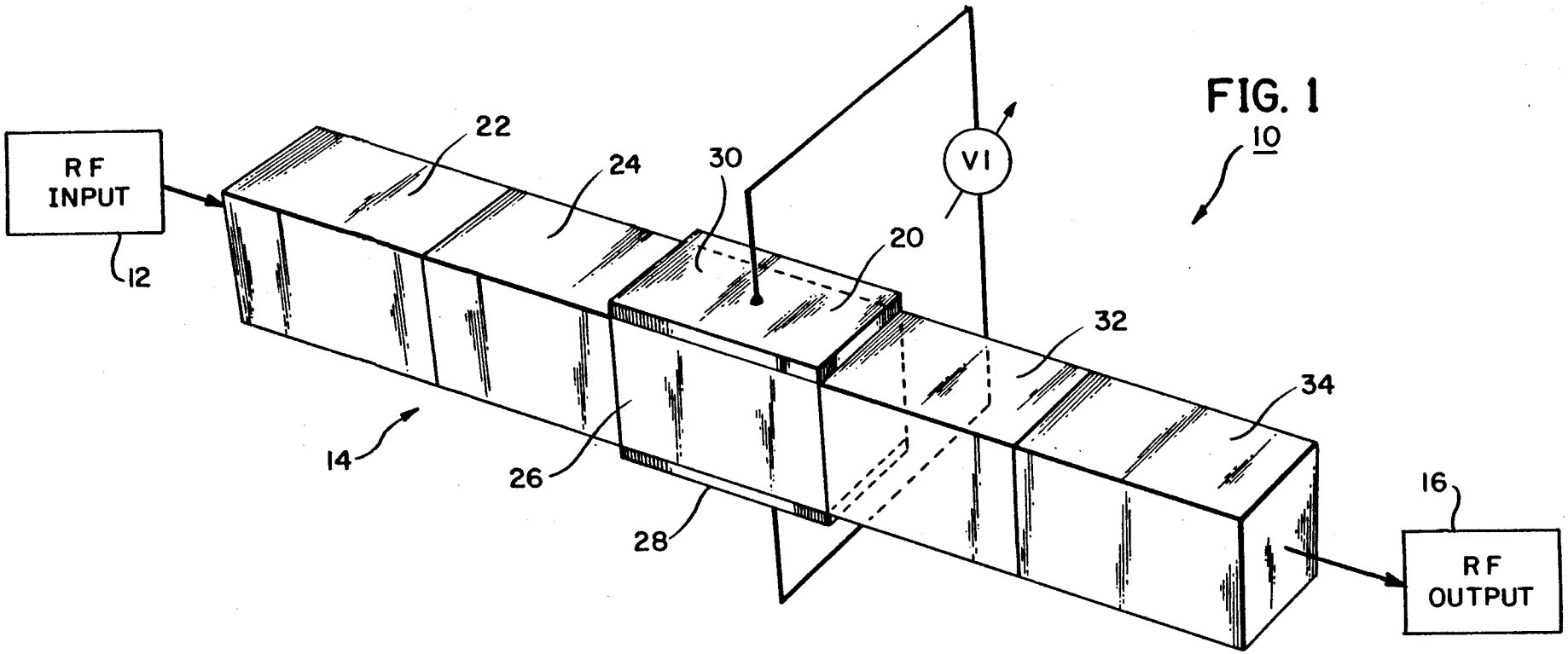
FIG. 1 is a pictoral, schematic diagram of a preferred embodiment.

Referring now to the drawings there is illustrated in FIG. 1 a typical microwave or millimeter wave circuit configuration that incorporates the principles of the present invention. Circuit 10 includes an RF input 12, an RF transmission line 14, and an RF output 16.

The circuit 10 might be a radar in which case RF input 12 may represent a signal generator which launches a radar signal onto transmission line 14 for transmission to a radar antenna, in this case RF output 16. The radar antenna, RF output 16, may be a conventional array antenna consisting of a number of individual radiating elements suitably spaced with respect to one another. The relative amplitude and phase of the signals applied to each of the elements would be controlled to obtain the desired radiation pattern from the combined action of all of the elements. The relative phases between the elements would determine the position of the main beam which can be steered by varying the relative phase shift between the elements of the array. Changes in the relative phase of the RF signals may be readily accomplished with a variable phase shifter 20 contained in the transmission line 14.

In addition to variable phase shifter 20, transmission line 14 also includes an input waveguide 22 having its input end connected to RF input 12. A conventional input impedance matching section 24 is connected between the output end of waveguide 22 and the input to variable phase shifter 20 to match the impedance of waveguide 22 to the impedance of the active section 26 of phase shifter 20. Section 24 may be a conventional quarter-wave transformer. The active section 26 is formed from a length of variable-permittivity material which is mounted between a pair of plate electrodes 28, 30. Phase shifter 20 includes an adjustable d-c voltage source V1 that is connected across electrodes 28, 30.

The output of phase shifter 20 is connected to an output impedance matching section 32 that impedance matches the output of phase shifter 20 to the input of waveguide 34. Section 32 may be designed to be similar to section 24. The RF output 16 is connected to the output end of waveguide 34.

The material from which the active section 26 is formed may be any material whose permittivity may be controlled over some effective range with an applied electric field via electrodes 28, 30. One such material is strontium-barium titanate. When formed as a single ceramic structure, strontium-barium titanate has a relatively high permittivity that can be varied when electric fields are applied thereto. Consequently, the electric length of the ceramic structure in section 26 can also be varied as a direct result of variations in the permittivity. As such, the phase of RF waves propagating through the ceramic structure that forms section 26 will be subjected to various phase shifts at the exit of section 26 depending on the strength of the applied electric field and the attendant changes in permittivity.

In order to minimize undesired RF propagation modes and effects, it is further contemplated that the electrodes 28, 30 be formed of a material that is a dielectric, having substantially the same permittivity as the ceramic material of section 26, for the RF frequencies of interest. Of course, it will also be necessary that the material of electrodes 28, 30 be a good conductor at d-c so as to be capable of applying the necessary electric field in response to application of control voltage V1. In the present invention, rubidium oxide may be used to fabricate electrodes 28, 30 when section 26 is formed from strontium-barium titanate.

The variation of permittivity in the ceramic material of section 26 with applied electric field via electrodes 28, 30 is necessary only for those components of the microwave beam that are polarized parallel to the applied field.

Figure 2:
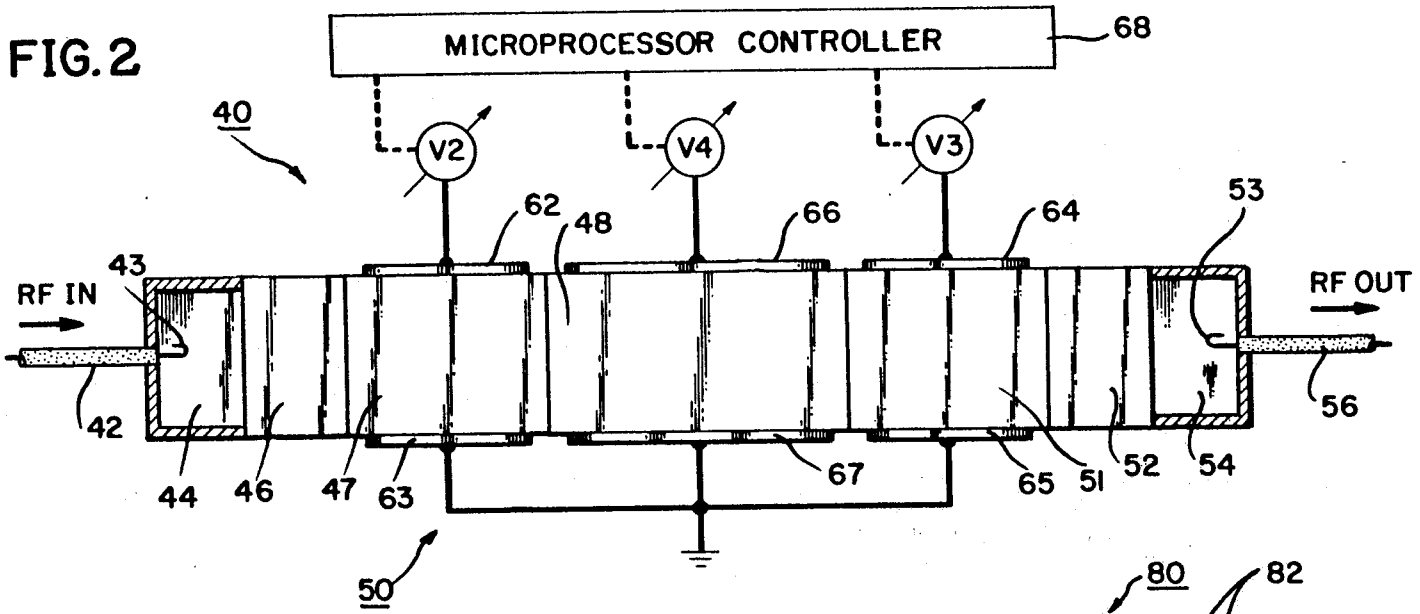
FIG. 2 is a schematic, side elevation of a modification of the preferred embodiment.

The embodiment illustrated in FIG. 2 shows an improvement over the basic ceramic phase shifter shown in FIG. 1. In the FIG. 2 configuration, the system 40 has active impedance matching sections that, in effect, replace the passive matching sections 24, 32 of FIG. 1. The input active matching section consists of an initial matching section 46 followed by an active section 47. Section 46 transforms from the impedance of RF input section 44 to the active section 47 of phase shifter 50. Section 47 is fabricated of a material whose permittivity, dimensions, and range of change of permittivity are designed to form the equivalent of a quarter-wave transformer into the main active phase shift section 48. Section 48, similar to the active section 26 of FIG. 1, is formed of a length of variable-permittivity material. A control voltage source V4 is connected across section 48 via electrodes 66, 67 for purposes of varying the permittivity of the material in section 48 and thereby controlling the phase of RF energy therein. A variable control voltage source V2 is connected across the active phase shift section 47 via electrodes 62, 63 for varying the permittivity of the material in section 47. The output of section 48 is followed by an output active impedance matching section similar to the input active impedance matching section. The output active matching section 51 is similar in structure and function to section 47. The final matching section 52 is similar in structure and function to the initial matching section 46. A variable control voltage source V3 is connected across section 51 via electrodes 64, 65 for varying the permittivity of the material in section 51.

The control voltage sources V2, V3, V4 are connected to a microprocessor controller 68. The controller 68 is used to determine the appropriate sets of voltages V2, V3, V4 to provide the desired phase shift as a function of the RF frequency while maximizing transmission through the phase shifter. The voltage source V2 may be adjusted to maximize RF power propagated into the main active section 48. Likewise the control voltage source V3 is adjustable to maximize RF power coupled out of the main active section 48. The external RF input transmission line 42 and RF output transmission line 56 are illustrated as being conventional RF coaxial cable or waveguide terminating in suitable structures 43, 53 to couple appropriately polarized RF energy into and out of the respective terminal areas 44, 54.

The basic phase shifters so far described are inherently low loss efficient structures capable of handling relatively large amounts of power. The phase shift is controlled by applying a voltage V1 (FIG. 1), V4 (FIG. 2) to a pair of low-loss capacitor plates (electrodes 28, 30, 66, 67). As a result, the phase shift may be controlled with a relatively small amount of control power consumption. Further, large amounts of power are easily handled by these phase shifter materials. As such, the sensitivity of the overall systems 10, 40 may be made significantly higher than what is attainable in conventional phase shifters.

Figure 3:
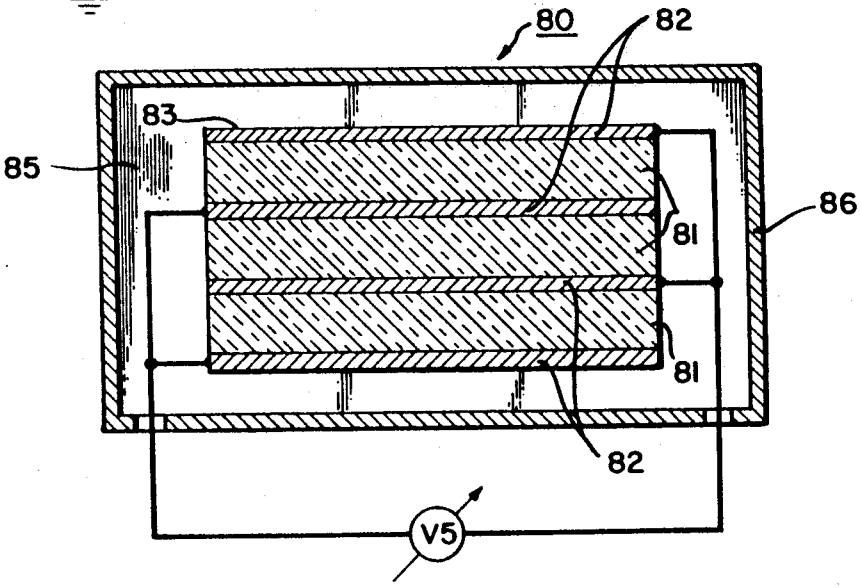
FIG. 3 is a sectional view of a modified version of a portion of the preferred embodiment.

FIG. 3 shows a cross-sectional view of a modified phase shifter 80 having a laminated active section 83 that forms an interdigitated electrode structure. Active section 83 is housed in an RF cavity 85 formed by a waveguide 86. The RF power may be considered to be coming out of the plane of FIG. 3 with vertical polarization. The active material 81, e.g. strontium-barium titanate, is sandwiched between plate electrodes 82 which, like the electrodes 20, 28, consist of a material (e.g. rubidium oxide) which is a dielectric having approximately the same permittivity as the active material 81 at the RF but a good conductor at d-c. Alternate electrodes 82 are electrically connected together and brought out of opposite sides of the cavity 85 for connection to an adjustable d-c voltage source V5. The interdigitated electrode structure shown here may be used to reduce the mount of control voltage V5 required to produce the electric field needed to change the permittivity of the material 81.

It is also conceived that the active section 83 may be removed from the cavity 85 and used as a stand alone variable capacitor. For this application, it is not necessary to use any special material for the electrodes 82 as the effective capacitance of the device at RF is a function of the d-c voltage applied. The FIG. 3 structure would have a higher RF power handling capability over a conventional varactor diode.

The phase shifters so far described are primarily meant to be packaged as stand alone components. Ceramic phase shifters made in accordance with the present invention may also be made a part of an integrated circuit.

Figure 4:
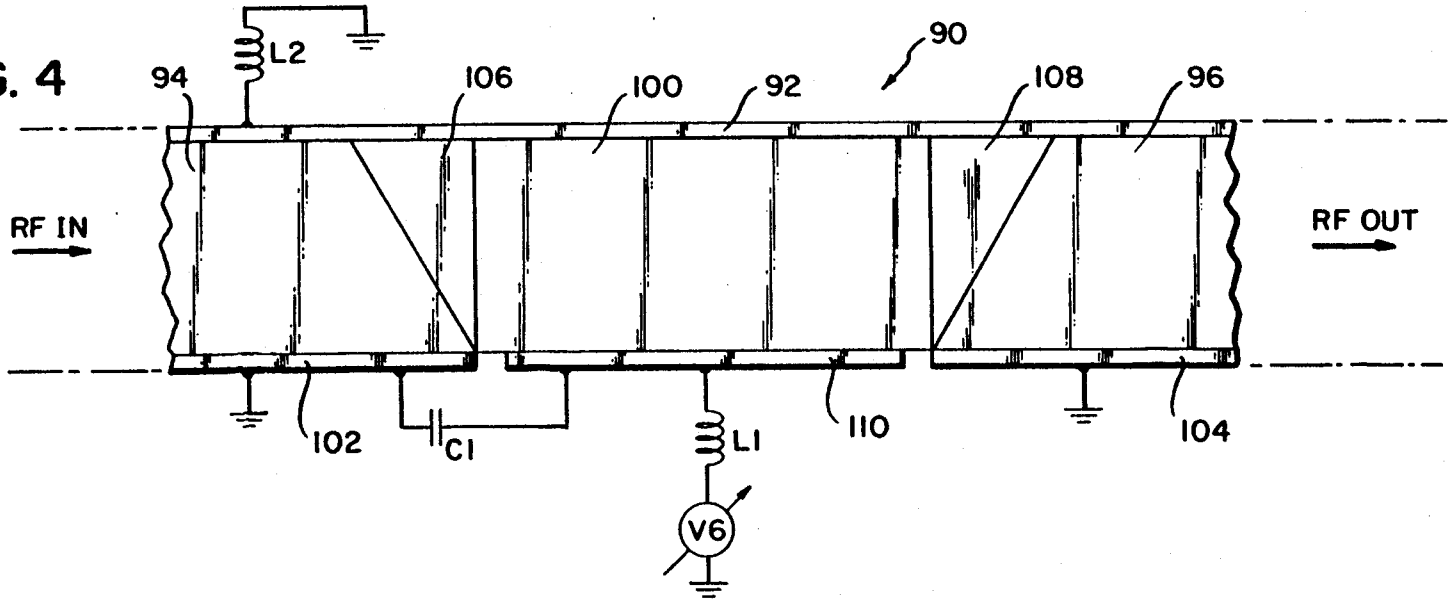
FIG. 4 is still another embodiment of the invention showing a schematic, side elevation.
Figure 5:
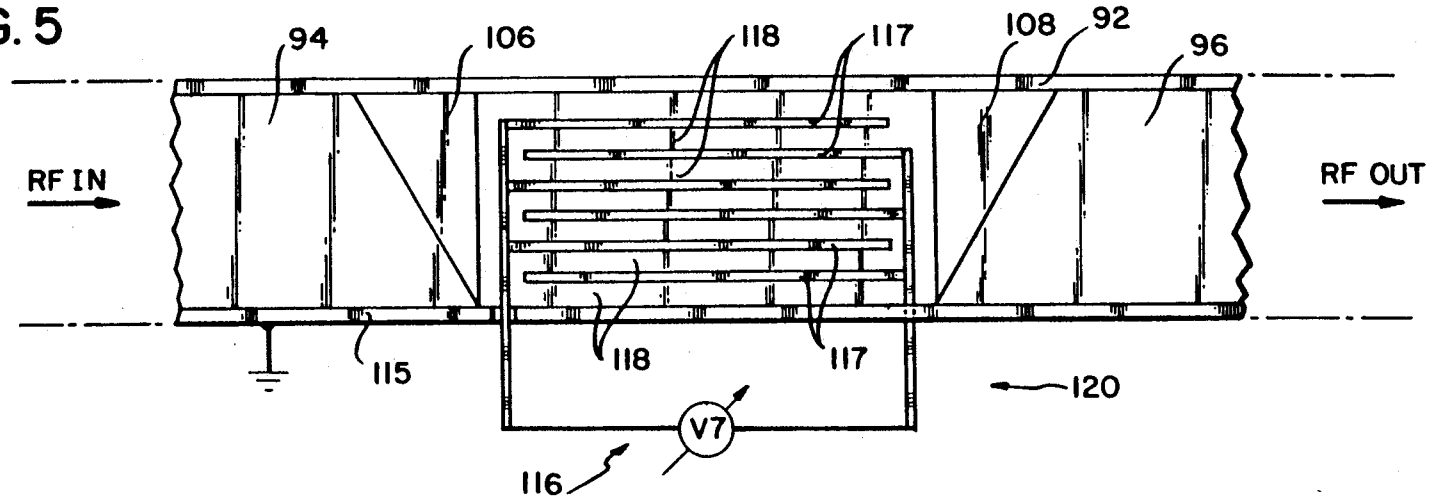
FIG. 5 is a view similar to FIG. 4 of yet another embodiment of the invention.

FIGS. 4 and 5 show schematic representations of microwave or millimeter wave transmission circuits of the type typically fabricated as integrated circuits with an electronic ceramic phase shifter embedded therein. FIG. 4 illustrates a portion of a microwave dielectric stripline transmission circuit 90 having an active material 100 whose permittivity may be varied with changes in an electric field applied to the material 100. The circuit 90 also includes a stripline conductor 92 laid over input and output dielectric substrates 94, 96, and ground plane conductors 102, 104, respectively. Conductor 92 passes over an input impedance matching wedge 106 located between the output end of dielectric substrate 94 and the input end of material 100. Conductor 92 also passes over an output impedance matching wedge 108 located between the output end of material 100 and the input end of dielectric substrate 108. The wedges 106, 108 schematically represent conventional impedance matching dielectric materials having a graded variation in the effective dielectric constant over their length or a variation in the dielectric stripline dimensions or both. The conductor 92 also passes over the active material 100 (e.g. strontium-barium titanate). An electrode 110 is attached to the undersurface of material 100 and lies in the common plane of ground plane conductors 102, 104. Conductor 110 is appropriately spaced from conductors 102, 104. An adjustable d-c voltage source V6 is connected to conductor 110 via series choke coil L1 that acts as an RF isolator of d-c source V6. The stripline conductor 92 is held at d-c ground by an RF choke coil L2. The electrode 110 is RF bypassed to ground by appropriate bypass capacitor C1.

The FIG. 4 structure operates as an RF phase shifter in the same manner described above for the FIG. 1 embodiment. The electrode 110 is biased with a d-c voltage from source V6 thereby creating a d-c electric field in material 100 which in turn will change the permittivity and, therefore, the electric length of material 100. As a result, the phase of the RF signal passing from material 100 to wedge 108 may be adjusted by adjusting the output voltage of d-c voltage source V6. The FIG. 4 configuration is suitable for fabrication as a microwave integrated circuit.

FIG. 5 shows another embodiment of an integrated-circuit type configuration. This embodiment is similar to the FIG. 4 structure except that the interdigitated feature of FIG. 3 is employed. The use of the interdigitated electrode will be more advantageous in some cases where it is inappropriate to affect the necessary d-c level on the stripline, or it is desired to reduce the magnitude of the control voltage applied.

The stripline transmission circuit 120 (FIG. 5) includes a stripline conductor 92, input dielectric substrate 94, output dielectric substrate 96, impedance matching wedges 106, 108, and a ground plane conductor 115 that extends continuously below substrates 94, 96 and the active portion of phase shifter 116. A series of parallel interdigitated electrodes 117 are embedded in the active material 118. Alternate electrodes are connected together and to opposite sides of an adjustable voltage source V7.

It should be understood, of course, that the foregoing disclosure relates to only preferred embodiments of the invention and that numerous modifications or alterations may be made therein without departing from the spirit and the scope of the invention as set forth in the appended claims.

What is claimed is:

1. An RF phase shifter comprising:

a body of solid dielectric material having a permittivity that is a function of an electric field in which it is immersed;

a first RF transmission means for coupling RF energy into said body;

a second RF transmission means for coupling RF energy from said body; and means for applying an electric field to said body to adjust the permittivity of said body, wherein said first RF transmission means includes an impedance matching means for coupling said RF energy into said body, wherein said impedance matching means is formed of a material having a permittivity that may be varied with an adjustable electric field and further including control voltage means for applying a d-c voltage to said matching means for changing the electrical length thereof.

2. An RF phase shifter comprising:

a body of solid dielectric material having a permittivity that is a function of an electric field in which it is immersed;

a first RF transmission means for coupling RF energy from said body;

a second RF transmission means for coupling RF energy from said body; and means for applying an electric field to said body to adjust the permittivity of said body, wherein said first RF transmission means includes an impedance matching means for coupling said RF energy into said body and wherein said second RF transmission means includes an impedance matching means for coupling said RF energy out of said body and wherein the impedance matching means of said second RF transmission means is formed of a material having a permittivity that may be varied with an adjustable electric field and further including control voltage means for applying a d-c voltage to said matching means of said second RF transmission means for changing the electrical length thereof.

3. An RF transmission circuit comprising:

a first dielectric stripline having an output end, a stripline conductor and a ground plane;

an input impedance matching means mounted at the output of said first dielectric stripline;

an RF phase shifter connected to the input impedance matching means, said shifter including a body of solid dielectric material having a permittivity that varies with an electric field in which it is immersed;

voltage means for applying an electric filed to said phase shifter;

an output impedance matching means connected to said phase shifter; and a second dielectric stripline having an input end connected to said output impedance matching means, a stripline conductor and a ground plane, wherein said voltage means includes first and second electrodes mounted on opposite sides of said body with said first electrode being connected to said stripline conductors and said second electrode mounted coplanar with said ground plane and spaced therefrom.

4. An RF transmission circuit comprising:

a first RF transmission line having an output end;

an input impedance matching means mounted at the output of said first RF transmission line;

an RF phase shifter connected to the input impedance matching means, said shifter including a body of solid dielectric material having a permittivity that varies with an electric field in which it is immersed;

voltage means for applying an electric filed to said phase shifter;

an output impedance matching means connected to said phase shifter; and a second RF transmission line having an input end connected to said output impedance matching means, wherein said first and second transmission lines are dielectric striplines having a stripline conductor and a ground plane with a dielectric material mounted therebetween and said input and output impedance matching means and said body mounted between said ground plane and said stripline conductor.

5. The circuit of claim 4 wherein said voltage means includes an interdigitated electrode embedded in said body.

6. An RF transmission circuit comprising:

a first RF transmission line having an output end;

an input impedance matching means mounted at the output of the first line;

an RF phase shifter connected to the input impedance matching means, said shifter including a body of material having a permittivity that varies with an electric field in which it is immersed;

voltage means for applying an electric field to said phase shifter;

an output impedance matching means connected to said phase shifter; and a second RF transmission line having an input end connected to said output impedance matching means;

said first and second transmission lines are dielectric striplines each having a stripline conductor and ground plane;

said voltage means including first and second electrodes mounted on opposite side of said body with said first electrode being connected to said stripline conductors and said second electrode mounted coplanar with said ground plane and spaced therefrom.

7. An RF transmission circuit comprising:

a first RF transmission line having an output end;

an input impedance matching means mounted at the output of the first line;

an RF phase shifter connected to the input impedance matching means, said shifter including a body of material having a permittivity that varies with an electric field in which it is immersed;

voltage means for applying an electric field to said phase shifter;

an output impedance matching means connected to said phase shifter; and a second RF transmission line having an input end connected to said output impedance matching means;

said first and second transmission lines are dielectric striplines having a stripline conductor and a ground plane with a dielectric material mounted therebetween and said input and output impedance matching means and said body mounted between said ground plane and said stripline conductor.

8. The circuit of claim 7 wherein said voltage means includes an interdigitated electrode embedded in said body.

* * * * *